United States Patent [19]

Deutsch

[11] 4,176,573

[45] Dec. 4, 1979

[54] INTRAKEYBOARD COUPLING AND TRANSPOSITION CONTROL FOR A KEYBOARD MUSICAL INSTRUMENT

[75] Inventor: Ralph Deutsch, Sherman Oaks, Calif.

[73] Assignee: Kawai Musical Instrument Mfg. Co. Ltd., Hamamatsu, Japan

[21] Appl. No.: 951,168

[22] Filed: Oct. 13, 1978

[51] Int. Cl.[2] ..... G10B 3/20; G10C 3/28; G10H 1/00

[52] U.S. Cl. ..... 84/1.01; 84/445

[58] Field of Search ..... 84/1.01, 1.24, 445

[56] References Cited

U.S. PATENT DOCUMENTS

| | | | |
|---|---|---|---|
| 3,610,800 | 10/1971 | Deutsch | 84/1.01 |
| 3,697,661 | 10/1972 | Deutsch | 84/1.01 |
| 3,800,060 | 3/1974 | Hallman, Jr. | 84/1.01 X |
| 3,836,909 | 9/1974 | Cockerell | 84/1.01 X |
| 3,890,871 | 6/1975 | Oberheim | 84/1.01 |
| 3,910,149 | 10/1975 | Obayashi | 84/1.01 |
| 3,933,072 | 1/1976 | Van der Wal et al. | 84/1.01 |
| 3,971,282 | 7/1976 | Obayashi et al. | 84/1.01 |
| 4,048,893 | 9/1977 | Coles | 84/1.01 |
| 4,056,032 | 11/1977 | Coles | 84/1.01 |
| 4,058,042 | 11/1977 | Wade et al. | 84/1.01 |

*Primary Examiner*—Stanley J. Witkowski
*Attorney, Agent, or Firm*—Christie, Parker & Hale

[57] ABSTRACT

A transposing and intramanual coupling control circuit for an electronic keyboard instrument in which the status of the keys are scanned in groups by a group counter, each group corresponding to the twelve notes of an octave. The keys in each group provide status signals on a corresponding number of time-shared output lines as each group is scanned. If any key in a particular group has changed status, the scanning of the groups is interrupted and the individual keys in the particular group are scanned by a note counter to determine which keys have changed status. If a key has been depressed, the note number and octave number in the respective counters are stored in an assignment memory for assignment to a tone generator. Transposition is provided by shifting the phasing between the key scanning by the note counter relative to the output lines by a predetermined set amount at the start of each group scanning step. Depending on the set amount, which can be changed at the group scanning rate, a transposed note number is stored along with the octave number in the assignment memory in response to depression of a given key in a group. If the transposed note number associated with a particular key is in the next octave, the octave number from the group counter is adjusted by one as stored in the assignment memory.

11 Claims, 2 Drawing Figures

INTRAKEYBOARD COUPLING AND TRANSPOSITION CONTROL FOR A KEYBOARD MUSICAL INSTRUMENT

FIELD OF THE INVENTION

This invention relates to keyboard-operated electronic musical instruments, and more particularly, is concerned with control apparatus for automatically transposing the pitch of the tone generated in response to operating any selected key on the keyboard by a predetermined number of half tones from the standard pitch for the selected key.

BACKGROUND OF THE INVENTION

Transposing involves the shifting of music from one musical key signature to another. Thus music written in one key can be transposed up or down any selected number of half tones to sound in another key. Automatic transposition systems for keyboard musical instruments are well known. This has been done, for example, by mechanically shifting the keyboard relative to the mechanism that initiates a tone so that each key is set to produce a note of the transposed musical scale. In U.S. Pat. No. 3,610,800, for example, there is described a keyboard instrument in which key-operated switches are detected by using conventional time division multiplexing. By assigning each key-operated switch to a unique time slot in each repetitive scanning cycle, an actuated switch causes a pulse to appear in a predetermined time slot. Transposition is obtained by in effect shifting the pulses to other time slots by delaying or advancing the pulses with respect to the start of a multiplexing cycle.

Closely related to the concept of transposing is that of intramanual coupling in which the playing of one note on the keyboard generates, in addition to the normal tone, one or more additional tones at preselected scale intervals, such as an octave higher or lower. U.S. Pat. No. 3,697,661, for example, describes an intramanual coupler in which the keys are time-division multiplexed in conventional manner, coupling being obtained by delaying the keyed pulses and adding the delayed pulses to the input time-division multiplexed key pulses. The added pulses are delayed to other time slots, generating tones at preselected coupler intervals.

SUMMARY OF THE INVENTION

The present invention is directed to a control circuit for providing transposition or intramanual coupling in which the transposition or intracoupling interval is dynamically controlled and can be continuously varied at a fast rate. The system of the present invention for implementing transposition and intramanual coupling is a modification to the basic key detect and assignor circuit described in U.S. Pat. No. 4,022,098 for detecting operation of keys on the keyboard and assigning tone generators to the keys as they are depressed.

In brief, the present invention provides a transposition control for a keyboard-operated electronic musical instrument in which each key operates a switch to produce a binary status signal indicating whether the key is depressed or released. The status signals from one group of keys corresponding to one octave are connected at one time to a corresponding number of output lines which are time-shared with all the groups of keys corresponding to the other octaves of the keyboard. The time-sharing sequence is controlled by a group counter which, as it counts, indicates the number of the octave whose status signals are currently applied to the output lines. If the status signal on one of the output lines indicates that a key in the particular group has changed status since the previous scanning cycle, the signals on the output lines are in turn scanned in response to a note counter. A parallel-to-serial converter-type circuit is interposed in the output lines for shifting the status signals relative to the output lines by a predetermined amount so that the status signal from one key of an octave is shifted to an output line corresponding to a different key of the octave. The amount of the shift is controlled by shifting the converter by an amount determined by a series of shift pulses corresponding in number to the number of half tones in the transposition. The shifted status signals appearing on the respective output lines are then used to store the count condition of the note counter and the group counter in an assignment in memory which stores the information identifying each of the transposed notes produced by the depressed keys on the keyboard. The group number stored in the memory is automaticallv changed by one for each note that is transposed into the next octave.

DESCRIPTION OF THE DRAWINGS

For a more complete understanding of the invention reference should be made to the accompanying drawings, wherein.

DETAILED DESCRIPTION

Figure 1:
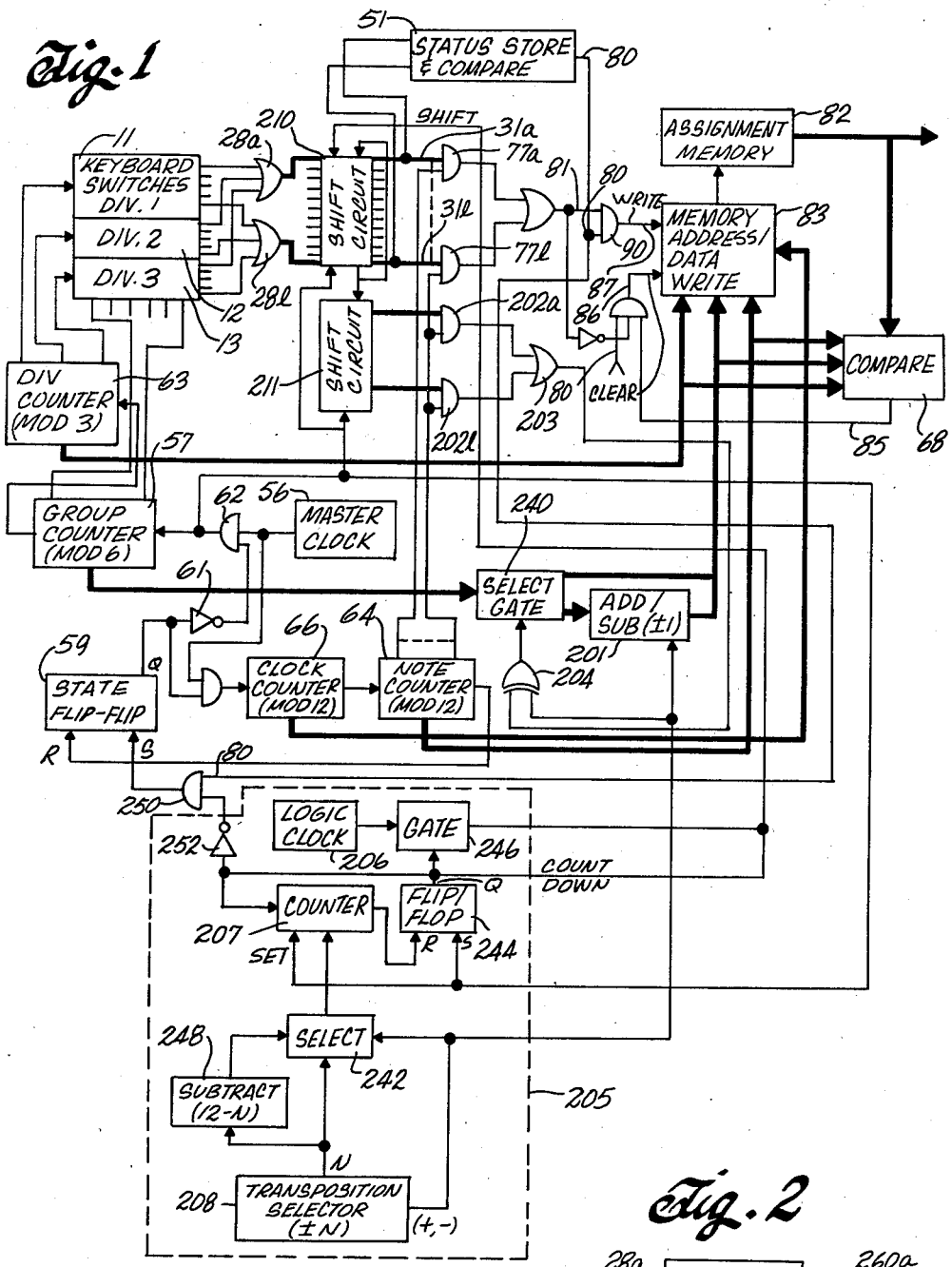
FIG. 1 is a schematic block diagram of a key detect and assignor circuit incorporating a transposition control.

The transposition control of the present invention is incorporated in a keyboard detect and assignor circuit of the type described in detail in U.S. Pat. No. 4,022,098, hereby incorporated by reference. In the drawings, the elements identified by two digit numbers correspond to the same number elements described in the patent.

Referring to FIG. 1 in detail, the keyboard instrument may have a number of manuals, such as an upper keyboard 11, a lower keyboard 12, and a pedal keyboard 13, referred to as division 1, 2, and 3. Each keyboard typically consists of six musical octaves referred to as groups 1 through 6. The groups are scanned in sequence by a group counter 57 which is counted by clock pulses from a master clock 56 through an AND gate 62. Overflow pulses from the group counter 57 advance a division counter 63 which activates the three divisions in sequence.

Each group, corresponding to one octave on a keyboard, consists of twelve keys for playing the twelve musical notes of the scale, namely, C, C♯, D, ... B. As shown in detail in U.S. Pat. No. 4,022,098, the keyboard circuitry includes individual key-operated switches arranged in groups of twelve, two groups being indicated respectively at 14 and 15 for group 1 and group 6. Each group of switches is activated by the coincidence of signals from the division and group counters on the division input line and on the associated group input line. The C note switch of each of the six groups of a division is connected to one of group of twelve output lines, one for each key of an octave, by a corresponding one of six input lines through an OR circuit. Similarly each of the other note switches of the several groups in a division are connected to corresponding ones of twelve output lines from the division. Each keyboard division circuit provides key status signals on twelve output lines corresponding to the status of the twelve notes of an octave, the twelve output lines being time-shared by the six octaves of the division. A signal on one of the output lines indicates the status of a corresponding one of the keys of an octave, the status of the division counter and group counter indicating the particular keyboard (division number) and octave (octave number) associated with the status signal. The twelve output lines of the three keyboards are combined by a group of twelve OR gates 28*a* through 28*l*.

As described in detail in the above-identified patent, the OR gates 28 provide twelve output lines 31*a* through 31*l*. Binary output signals on these lines at a particular time indicate the status of the twelve key-operated switches of the octave and keyboard identified by the group counter 57 and division counter 63. If any of the keys has changed status since the previous scanning cycle of the division and group counters, a signal is generated on line 80 by a status store and compare circuit, indicated generally at 51. In a manner described in detail in U.S. Pat. No. 4,022,098, the status information on the twelve lines 31*a* through 31*l* is stored in groups of twelve registers, each register storing status bits for one of the notes, e.g., C through B, for all of the octaves. At the time when the status signals of a particular octave are connected to the line 31*a* through 31*l*, a comparison is made with the previously stored status bits in the registers to determine if any key in the octave has changed status. If so, the level on line 80 goes true. This change of status signal sets a State flip-flop 59. When the State flip-flop 59 is set, it interrupts the flow of master clock pulses through the AND gate 62 to the group counter, stopping the counting of the group and division counters, and initiates an assignment mode in which a tone generator is assigned to a key which has been depressed, or is released from a note which has been released.

In the assignment mode, a clock counter 66 receives master clock pulses. The clock counter 66 is a modulo 12 counter so that every twelfth pulse provides an overflow which counts a note counter 64. As the note counter 64 advances it scans each of the output lines 31*a* through 31*l* by successively activating AND gates 77*a* through 77*l*. If the key identified by the note counter has been depressed since the previous scan cycle, a Write signal will appear on the line 87 which causes the status of the group counter 57, division counter 63, and note counter 64 to be written into an assignment memory 82 by the memory address/data write control 83. The clock counter is used to successively address the twelve words stored in the assignment memory used to control a corresponding number of tone generators.

If a particular key has been released since the last scanning cycle, a compare circuit 68 compares each of the words in the assignment memory with the current status of the division, group and note counters to find the control word of the released note in the assignment memory. When a comparison takes place, a clearing signal is applied on line 86 to the memory address/data write control 83 for clearing the corresponding word in the assignment memory 82.

As thus for described, the circuit of FIG. 1 is identical to that described in greater detail in the above-identified U.S. Pat. No. 4,022,098.

To provide automatic transposition, the key status signals at the output of the logical OR circuits 28*a* through 28*l* are shifted relative to the lines 31*a* through 31*l* of the assignment control logic. The shifting is provided by a shift register type circuit 210 operated in an end-around mode. The register 210 is loaded in parallel by the output lines from the logical OR circuits 28*a* through 28*l*. The binary status information of the twelve input lines is then shifted by any predetermined amount relative to the parallel output lines 31*a* through 31*l*. Thus if one shift pulse is applied to the input of the register 210, the incoming status signal on the line 28*a* will appear on the output line 31*b*. Because of the end-around mode of operation, the key status signal appearing on the input line 28*l* will appear on the output line 31*a*. Thus each input pulse on the shift input will result in a transposition upward on the musical scale of an additional half tone of the note identified by information stored in the assignment memory 82 during the assignment mode of operation relative to the actual key depressed.

Because a transposition shift of the note B in the end-around mode to the output line corresponding to note C involves a shift into the next higher octave, some means must be provided for changing the status of the group counter information stored in the assignment memory 82 during the assignment mode. This is accomplished by providing a second shift register 211 serially connected to the output of the shift register 210. Thus whenever the transposition shift causes a note to be shifted into the next higher group, it is at the same time shifted into the second register 211. The status information shifted into the register 211 is read out in parallel to a group of AND gates 202*a* through 202*l* to which the twelve outputs from the note counter 64 are respectively connected. The twelve outputs from the AND gates 202*a* through 202*l* are applied through an OR circuit 203 and an Exclusive OR circuit 204 to a select gate 240 which gates the output of the group counter 57 either directly to the memory address/data write control 83, or connects the output of the group counter to an Add/Subtract circuit 201. The circuit 201 in response to a sign control input signal either adds or subtracts 1 from the value of the group counter. Assuming that a transposition up (+) is being implemented, the group counter information stored in the assignment memory 82 will be incremented by 1 if the transposition has caused the transposed note to be in the next octave up. For example, if the key corresponding to the note B on the keyboard is depressed, and the note is transposed up one-half tone so as to correspond to the note C of the next higher octave, the depressed key will cause a signal on the output of the OR circuit 28*l* to be shifted to the output line 31*a* and also be shifted to the shift register 211 so as to provide a output signal from the AND gate 202*a*. This causes the select gate 240 to direct the output from the group counter 57 through the Add/Subtract circuit 201 where the group count is incremented by 1 before being stored in the assignment memory 82.

The shifting of the registers 210 and 211 by a number of shifts corresponding to the desired number of half tones of transposition is provided by a transposition control circuit indicated generally at 205. The control circuit 205 is activated with each advance of the group counter 57 by the master clock 56. The shift pulses applied to the shift registers 210 and 211 are derived from a logic clock 206 having a clock frequency very much higher than that of the master clock 56.

Each master clock derived from the output of the AND gate 62 is used to set a counter 207 selectively to a value N when transposing up (+) or a value 12-N when transposing down (−), the value of N corresponding to the number of half tones of transposition. The value N is set by a transposition selector 208. Transposing down is accomplished in effect by transposing up by a value 12-N and adjusting the group number accordingly.

Assuming it is desired to transpose up by a value N, the transposition selector provides a coded output signal corresponding to the value N which is applied through a select gate 242 to the counter 207 for setting the counter to the value N. At the same time the counter is set to the value N by a clock pulse from the master clock, a control flip-flop 244 is set, thereby opening a gate 246 for gating pulses from the logic clock 206 to the shift input of the registers 210 and 211. The pulses at the output of the gate 246 are also used to count down the counter 207. When the counter is counted down to zero, the flip-flop 244 is reset, interrupting further shifting of the registers 210 and 211. The transposition selector provides an output signal to the Add/Subtract circuit 201 and to the select gate 242 to indicate whether the transposition is + or −. If −, the value of N is subtracted from twelve by a subtract circuit 248 and applied to the counter 207. At the same time, the Add-/Subtract circuit 201 is set to subtract 1 from the group number for all notes shifted into the next lower octave by the transposition shift. The select gate 240 diverts the output of the group counter 57 to the Add/Subtract circuit 201 only if no key-activated status signal is shifted to the shift register 211.

It will be appreciated from the above description that the transposition takes place with every master clock pulse, which means that the transposition selector can be changed at the master clock rate. The effect of changing the value of N by the transposition selector on the keyboard detect and assignor circuit is the equivalent electrically of physically releasing one key and depressing the key corresponding to the transposed note. In other words, the key detect and assignor circuit will recognize the transposition as a change in status of a key, causing the State flip-flop 59 to be set and the assignment mode instituted. The contents of the assignment memory are then modified to reflect the transposition from one note to another for the same depressed key even though no keys on the keyboard have been released or depressed by the musician. To insure that the transposition shift is complete before entering the assignment mode, an AND gate 250 is interposed between the control line 80 and the State flip-flop 59. The gate 250 is controlled by the flip-flop 244 through an inverter 252, so that the flip-flop 59 can only be set after the flip-flop 244 is reset.

The transposition selector circuit 208 may provide for manual selection of the transposition value N by the musician. However, the value of N may be changed dynamically to produce special effects not heretofore possible. Thus key register changes may be made at a controlled rate in jumps of up to twelve half tones (one octave) in either direction by providing a suitable generator for controlling the value of N.

Figure 2:
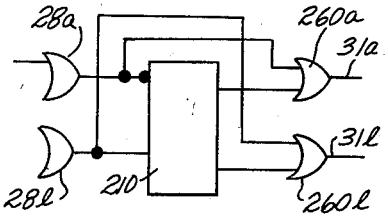
FIG. 2 is a modification to the control circuit of FIG. 1 for providing an intramanual coupling control.

To provide intermanual coupling within the same octave, such as transposing by either a musical third or fifth, the output of the logical OR circuits 28*a* through 28*l* include a line bypassing the shift register 210 and connected through an OR circuit 260 to the corresponding one of the lines 31*a* through 31*l*, in the manner shown in FIG. 2. This has the effect of assigning two notes in the assignment memory for each key that is actuated on the keyboard. The two notes are the note corresponding to the key that is pressed plus an additional transposed note which may offset in tone by any number of half tones according to the setting of the transposition selector 208, for example, four half tones for a third, or seven half tones for a fifth musical interval.

As described above, the transposing and intramanual coupling features involve all three divisions or manuals. However, the operation can be limited to any one of the manuals by interposing the shift register 210 between the twelve output lines from the respective division and the inputs to the logical OR circuits 28*a* through 28*l*. The result is to limit the transposition shift only to the status signals derived from the one division, the operation otherwise being identical to that described above.

What is claimed is:

1. In a keyboard switch and assignor circuit of the type in which keys of the keyboard are arranged in groups, each group corresponding to the notes of one octave, the groups being scanned in sequence in synchronism with a master clock, the status of each of the keys of each group as it is scanned being read out in binary form on a corresponding number of parallel output lines, the current status information on each of said lines being compared with the prior status stored in a group of registers to indicate when a key has changed status, a change in status of any of the keys in a group when scanned causing a word identifying the note associated with the key to be stored or cleared in an assignment memory depending on whether the change in status indicates a key has been activated or released, the word stored in the assignment memory identifying the key by note and octave, apparatus for transposing the notes associated with the keys of the keyboard by a selected number of half tones, comprising: shifting means interconnecting the parallel status lines with the status storing registers, means generating electrically coded signals indicating the number of musical half tones to be transposed, and means responsive to said coded signals for setting the shifting means to switch the current status signals on each of the lines to a different one of said status storing registers.

2. The apparatus of claim 1 further including means including a note counter for reading out the status of a selected group of keys from said register in sequence.

3. Apparatus of claim 1 further including means sensing when a status signal indicating a key has been depressed is switched by the shifting means by an amount exceeding the number of half tones difference between the depressed key and the highest or lowest note in the octave for adjusting the octave information stored in the assignment memory by one octave.

4. In a keyboard operated electronic musical instrument in which musical sounds are generated in response to activation of keyboard switches, the keyboard switches corresponding to notes arranged in groups corresponding to musical octaves and in which a key detect and assignor circuit stores data indicating the note to be generated in response to the activation of any selected keyboard switch, the keyboard detect and assignor circuit having an automatic transposing control comprising: a clock means for creating clock time signals, group counter means for counting said clock time signals modulo the number of musical octaves in a keyboard, a gating means responsive to the contents of said group counter for scanning the keyboard switches in groups to generate status signals representing the status of said keyboard switches for each group in succession on a common group of output lines, each line corresponding to a different note in a musical octave, status memory means for receiving and storing data from said group of output lines in parallel to be thereafter read out, the memory means receiving the states of the status signals for each group in succession, and transposing means for switching said common group of output lines relative to the inputs to said status memory means whereby the status signals on said output lines can be stored in selected locations in said status memory means to thereby cause the automatic transposition of said keyboard switches relative to the assigned locations in the status memory means.

5. Apparatus of claim 4 wherein the transposing means includes means responsive to a coded input signal for shifting the common group of output lines relative to the inputs to the registers by an amount N corresponding to the value of the coded input signal.

6. Apparatus of claim 5 further including means changing the count number from the group counter stored in the assignment memory by one when the associated note number from the note counter is greater than 12−N.

7. In a keyboard operated electronic musical instrument in which each key operates a switch to produce a status signal indicating whether the key is depressed or released, a key detect and assignor circuit having an automatic transposing control for storing data indicating a note to be generated in response to operation of any selected key on the keyboard, the key detect and assignor circuit comprising: means including a group counter and means periodically advancing the counter by one count for connecting groups of key-operated switches in succession with each count of the counter to a common group of output lines, there being one output line per switch in each group, whereby switch status signals for the switches in each of the groups in sequence are provided on respective ones of the output lines in parallel with each successive count of the group counter, a plurality of status registers, one register for each output line, each register storing the status of one key in each group, a note counter for successively identifying all of the notes in a group as the note counter advances, transposing means for connecting said common group of output lines to the inputs of any selected ones of the registers, whereby any selected key in each of the groups can be connected with any particular register, the status registers storing the status of the switches to which respective registers are connected by the transposing means, means responsive to a change in the status signal from operation of any of said keys on any of said output lines relative to the status of the corresponding key stored in the associated register for interrupting the counting of the group counter and starting the counting of the note counter, an assignment memory, means controlled by the note counter for scanning the inputs to the registers from the transposition means in a fixed sequence, and means for storing the contents of the note counter and group counter in the assignment memory when a scanned input line indicates the associated key is depressed and comparison with the status in the register connected with a particular key by the transposing means indicates a change in status.

8. Apparatus of claim 7 wherein the transposing means includes means responsive to a coded input signal for shifting the common group of output lines relative to the inputs to the registers by an amount N corresponding to the value of the coded input signal.

9. Apparatus of claim 8 further including means changing the count number from the group counter stored in the assignment memory by one when the associated note number from the note counter is greater than 12−N.

10. Apparatus of claim 7 wherein the group counter means generates a group reset signal when a clock time signal causes the group counter to return to its initial state, and a division counter means for counting said group reset signals modulo the number of divisions in said musical instrument, said gating means for scanning the keyboard switches including means responsive to the contents of the division counter for scanning the switches in each of the divisions in sequence.

11. Apparatus of claim 7 wherein the transposing means includes means responsive to a coded input signal for shifting the common group of output lines relative to the status registers by an amount N corresponding to the value of the coded input signal.

* * * * *